US008736167B2

(12) United States Patent
Shibata et al.

(10) Patent No.: US 8,736,167 B2
(45) Date of Patent: May 27, 2014

(54) METAL HALIDE LAMP

(75) Inventors: Yoshihisa Shibata, Saitama (JP); Kenji Okayasu, Saitama (JP); Shinji Tazawa, Saitama (JP)

(73) Assignee: Iwasaki Electric Co., Ltd., Tokyo (JP)

( * ) Notice: Subject to any disclaimer, the term of this patent is extended or adjusted under 35 U.S.C. 154(b) by 196 days.

(21) Appl. No.: 13/301,959

(22) Filed: Nov. 22, 2011

(65) Prior Publication Data

US 2012/0126696 A1 May 24, 2012

(30) Foreign Application Priority Data

Nov. 22, 2010 (JP) ..... 2010-260395

(51) Int. Cl.
*H01J 17/20* (2012.01)
*H01J 61/12* (2006.01)

(52) U.S. Cl.
USPC ..... 313/637; 313/640; 313/643

(58) Field of Classification Search
USPC ..... 313/637–643
See application file for complete search history.

(56) References Cited

U.S. PATENT DOCUMENTS

| | | | | |
|---|---|---|---|---|
| 3,670,193 | A * | 6/1972 | Thorington et al. | 313/642 |
| 3,876,895 | A * | 4/1975 | Lake et al. | 313/642 |
| 4,027,190 | A * | 5/1977 | Shintani et al. | 313/639 |
| 4,439,711 | A * | 3/1984 | Murakami et al. | 313/639 |
| 2005/0134182 | A1 * | 6/2005 | Ishigami et al. | 313/638 |

FOREIGN PATENT DOCUMENTS

| | | | |
|---|---|---|---|
| JP | 03-049530 | B2 | 3/1989 |
| JP | 2003-339236 | A | 12/2003 |
| JP | 2009-087602 | A | 4/2009 |

OTHER PUBLICATIONS

Japan Engineering Association for Biological Environment 2010 Kyoto Meeting (Sep. 8-10, 2010).

* cited by examiner

*Primary Examiner* — Mariceli Santiago
(74) *Attorney, Agent, or Firm* — Westerman, Hattori, Daniels & Adrian, LLP

(57) ABSTRACT

A metal halide lamp having a luminous tube formed of translucent alumina as translucent ceramic in which additives of halides are sealingly included to emit at least red, blue and green light components, wherein an energy rate of a red light component is set to 55% to 75% and an energy ratio of a blue light component is set to 15% to 25%.

2 Claims, 13 Drawing Sheets

FIG.1

(OUTPUT OF LAMP: 150W)

| | | EMBODIMENT | COMPARATIVE EXAMPLE |
|---|---|---|---|
| LELIGHT AMOUNT BALANCE: PHOTON FLUX RATIO [%] | RED COLOR | 48.7 | 42.6 |
| | GREEN COLOR | 26.6 | 40.9 |
| | BLUE COLOR | 21.7 | 16.4 |
| PHOTON FLUX RATIO OF RED COLOR LIGHT/BLUE COLOR LIGH | — | 2.2 | 2.6 |
| PHOTON FLUX DENSITY [$\mu$ mol·m$^{-2}$·s$^{-1}$] | — | 21.0 | 21.1 |
| ENERGY (RADIANT FLUX) | RED COLOR | 42.4 | 37.7 |
| | GREEN COLOR | 30.3 | 41.8 |
| | BLUE COLOR | 27.3 | 20.5 |
| ENERGY RATIO OF RED COLOR LIGHT/BLUE COLOR LIGHT | — | 1.6 | 1.83 |

FIG.3

TEST CONDITION FOR RICE SEEDLING CULTIVATION

| GROWTH STAGE | | | RAISING SEEDLING PERIOD | VEGETATIVE GROWTH PERIOD |
|---|---|---|---|---|
| TEST PERIOD [DAY] | | | 14 | 30 |
| BRIGHT PERIOD | LIGHT AMOUNT [μmol·m-2·s-1] | EMBODIMENT | 260 | 427 |
| | | COMPARATIVE EXAMPLE | | 398 |
| | TEMPERATURE[°C] | | 27 | |
| | HUMIDITY[%] | | 50 | |
| | TIME[H] | | 16 | |
| DARK PERIOD | TEMPERATURE[°C] | | 24 | |
| | HUMIDITY[%] | | 80 | |
| | TIME[H] | | 8 | |

- RICE VARIETY : NIHONBARE (GENE-UNMODIFIED RICE)
- CULTURE SOLUTION : STANDARD DENSITY OF CULTURE SOLUTION COMPONENT DESCRIBED IN "RICE CULTIVATION METHOD" WRITTEN BY TADAHIKO MAEDA, IN PLANT CELL ENGINEERING, VOL. 5, NO. 3, 1993

FIG.5

(OUTPUT OF LAMP: 400W)

| | | EMBODIMENT | COMPARATIVE EXAMPLE |
|---|---|---|---|
| LELIGHT AMOUNT BALANCE: PHOTON FLUX RATIO [%] | RED COLOR | 70.8 | 38.3 |
| | GREEN COLOR | 14.1 | 40.0 |
| | BLUE COLOR | 15.1 | 21.7 |
| PHOTON FLUX RATIO OF RED COLOR LIGHT/BLUE COLOR LIGH | — | 4.7 | 1.8 |
| PHOTON FLUX DENSITY [$\mu$ mol·$m^{-2}$·$s^{-1}$] | — | 44.7 | 53.5 |
| ENERGY (RADIANT FLUX) | RED COLOR | 65.0 | 33.0 |
| | GREEN COLOR | 15.0 | 40.1 |
| | BLUE COLOR | 20.0 | 26.9 |
| ENERGY RATIO OF RED COLOR LIGHT/BLUE COLOR LIGHT | — | 3.25 | 1.23 |

FIG.7

TEST CONDITION FOR RICE CULTIVATION

| GROWTH STAGE | | | RAISING SEEDLING PERIOD | VEGETATIVE GROWTH PERIOD | REPRODUCTIVE PERIOD |
|---|---|---|---|---|---|
| TEST PERIOD [DAY] | | | 20 | 30 | 60 |
| BRIGHT PERIOD | LIGHT AMOUNT [μmol·m-2·s-1] | EMBODIMENT | 450 | 780 | |
| | | COMPARATIVE EXAMPLE | | 940 | |
| | TEMPERATURE[°C] | | 26 | 27 | 27 |
| | HUMIDITY[%] | | 80 | 70 | 70 |
| | TIME[H] | | 16 | 12 | 12 |
| DARK PERIOD | TEMPERATURE[°C] | | 24 | 23 | 23 |
| | HUMIDITY[%] | | 80 | 70 | 70 |
| | TIME[H] | | 8 | 12 | 12 |

・RICE VARIETY : NIHONBARE (GENE-UNMODIFIED RICE)

・CULTURE SOLUTION : STANDARD DENSITY OF CULTURE SOLUTION COMPONENT DESCRIBED IN "RICE CULTIVATION METHOD" WRITTEN BY TADAHIKO MAEDA, IN PLANT CELL ENGINEERING, VOL. 5, NO. 3, 1993

FIG.10A

INCLUSION AMOUNT (EXCLUDING MERCURY)

| | SPECIFICATION OF ADDITIVES: mg | | | | | | | | TOTAL INCLUSION AMOUNT |
|---|---|---|---|---|---|---|---|---|---|
| | DyI3 | HoI3 | TmI3 | TlI | NaI | CaI2 | LiI | HgI2 | |
| COMPARATIVE EXAMPLE | 2.1 | 2.1 | 2.1 | 3.0 | 3.7 | 4.0 | – | – | 17.0 |
| EMBODIMENT (RICE SEEDLING CULTIVATION TEST) | 1.2 | 1.2 | – | 0.2 | 0.6 | 1.5 | 1.0 | – | 5.7 |
| EMBODIMENT (RICE CULTIVATION TEST) | 0.2 | 0.2 | – | – | 0.6 | 4.0 | 7.0 | – | 12.0 |
| EMBODIMENT (DIMMABLE TYPE) | 0.2 | 0.2 | – | – | 0.6 | 9.0 | 11.0 | 1.0 | 21.0 |

FIG.10B

INCLUSION WEIGHT RATIO (EXCLUDING MERCURY)

| | SPECIFICATION OF ADDITIVES: % | | | | | | | | TOTAL WEIGHT RATIO |
|---|---|---|---|---|---|---|---|---|---|
| | DyI3 | HoI3 | TmI3 | TlI | NaI | CaI2 | LiI | HgI2 | |
| COMPARATIVE EXAMPLE | 12.4 | 12.4 | 12.4 | 17.6 | 21.8 | 23.5 | – | – | 100 |
| EMBODIMENT (RICE SEEDLING CULTIVATION TEST) | 21.1 | 21.1 | – | 3.5 | 10.5 | 26.3 | 17.5 | – | 100 |
| EMBODIMENT (RICE CULTIVATION TEST) | 1.7 | 1.7 | – | – | 5.0 | 33.3 | 58.3 | – | 100 |
| EMBODIMENT (DIMMABLE TYPE) | 1.0 | 0.95 | – | – | 2.9 | 42.9 | 52.4 | NOTE) EXCLUDED | 100 |

FIG.10C

MOLE RATIO (%)

| | SPECIFICATION OF ADDITIVES: % | | | | | | | | TOTAL MOLE RATIO |
|---|---|---|---|---|---|---|---|---|---|
| | DyI3 | HoI3 | TmI3 | TlI | NaI | CaI2 | LiI | HgI2 | |
| COMPARATIVE EXAMPLE | 6.6 | 6.5 | 6.5 | 15.4 | 41.9 | 23.1 | – | – | 100 |
| EMBODIMENT (RICE SEEDLING CULTIVATION TEST) | 10.2 | 10.2 | – | 2.8 | 18.5 | 23.6 | 34.6 | – | 100 |
| EMBODIMENT (RICE CULTIVATION TEST) | 0.5 | 0.5 | – | – | 5.7 | 19.3 | 74.0 | – | 100 |
| EMBODIMENT (DIMMABLE TYPE) | 0.3 | 0.3 | – | – | 3.4 | 26.1 | 69.9 | NOTE) EXCLUDED | 100 |

FIG.10D

VOLUME RATIO (mg/cc)

| | SPECIFICATION OF ADDITIVES: mg/cc | | | | | | | |
|---|---|---|---|---|---|---|---|---|
| | DyI3 | HoI3 | TmI3 | TlI | NaI | CaI2 | LiI | HgI2 |
| COMPARATIVE EXAMPLE | 0.294 | 0.294 | 0.294 | 0.420 | 0.518 | 0.560 | – | – |
| EMBODIMENT (RICE SEEDLING CULTIVATION TEST) | 0.966 | 0.966 | – | 0.161 | 0.483 | 1.208 | 0.805 | – |
| EMBODIMENT (RICE CULTIVATION TEST) | 0.028 | 0.028 | – | – | 0.084 | 0.560 | 0.980 | – |
| EMBODIMENT (DIMMABLE TYPE) | 0.028 | 0.028 | – | – | 0.084 | 1.260 | 1.540 | NOTE) EXCLUDED |

NOTE) CALCULATED AT 1.242cc

FIG.11A

LIGHTING AT 400W (100% LIGHTING CONTROL) [SUBSEQUENT TO RICE SEEDLING PERIOD]

| ELECTRICAL CHARACTERISTIC | | | OPTICAL CHARACTERISTIC | | | | | | |
|---|---|---|---|---|---|---|---|---|---|
| LAMP POWER [W] | LAMP VOLTAGE [V] | LAMP CURRENT [A] | PHOTON FLUX DENSITY [$\mu$mol·m$^{-2}$·sec$^{-1}$·nm$^{-1}$] | PHOTON FLUX RATIO | | | ENERGY RATIO | | |
| | | | | RED COLOR | GREEN COLOR | BLUE COLOR | RED COLOR | GREEN COLOR | BLUE COLOR |
| 394.6 | 105.44 | 3.749 | 52.15 | 68 | 15 | 17 | 62 | 16 | 23 |

FIG.11B

LIGHTING AT 265W (65% LIGHTING CONTROL) [RICE SEEDLING PERIOD]

| ELECTRICAL CHARACTERISTIC | | | OPTICAL CHARACTERISTIC | | | | | | |
|---|---|---|---|---|---|---|---|---|---|
| LAMP POWER [W] | LAMP VOLTAGE [V] | LAMP CURRENT [A] | PHOTON FLUX DENSITY [$\mu$mol·m$^{-2}$·sec$^{-1}$·nm$^{-1}$] | PHOTON FLUX RATIO | | | ENERGY RATIO | | |
| | | | | RED COLOR | GREEN COLOR | BLUE COLOR | RED COLOR | GREEN COLOR | BLUE COLOR |
| 265 | 99.38 | 2.671 | 31.33 | 69 | 15 | 15 | 63 | 16 | 21 |

FIG.13

| LAMP POWER [W] | LAMP VOLTAGE [V] | LAMP CURRENT [A] | LIGHTING CONTROL | ENERGY RATIO | | |
|---|---|---|---|---|---|---|
| | | | | R | G | B |
| 398 | 105.2 | 3.79 | 100% LIGHTING | 62.0 | 15.5 | 22.5 |
| 360 | 102.2 | 3.53 | 90% | 62.2 | 15.4 | 22.5 |
| 321 | 99.8 | 3.22 | 80% | 62.5 | 15.4 | 22.1 |
| 281 | 98.3 | 2.86 | 70% | 62.8 | 15.7 | 21.4 |
| 266 | 98.2 | 2.71 | 60% | 62.9 | 16.0 | 21.2 |
| 281 | 98.2 | 2.86 | 70% | 63.0 | 15.7 | 21.3 |
| 321 | 99.5 | 3.24 | 80% | 62.5 | 15.3 | 22.2 |
| 361 | 102.1 | 3.54 | 90% | 62.0 | 15.2 | 22.8 |
| 395 | 104.6 | 3.79 | 100% | 61.6 | 15.4 | 23.0 |

METAL HALIDE LAMP

The present application claims priority under 35 U.S.C. §119 to Japanese Patent Application No. 2010-260395 filed on Nov. 22, 2010. The content of the application is incorporated herein by reference in its entirety.

BACKGROUND OF THE INVENTION

1. Field of the Invention

The present invention relates to a metal halide lamp, and particularly to a lamp which is suitably used for cultivation of plants.

2. Description of the Related Art

Much attention has been recently paid to plant factories because the plant factories have a merit that various kinds of plants can be stably produced and supplied with high quality irrespective of weathers and surrounding environments.

The types of plant factories are roughly classified into a sunlight using type in which plants are cultivated by basically using sunlight as main light and using artificial light as auxiliary light, and a perfectly artificial light type in which plants are cultivated under an enclosed environment with using no sunlight. Plant factories which cultivate plants under the enclosed environment are also called as enclosed type plant factories, and they can perform plant cultivation which is never influenced by weathers and surrounding environments because cultivation conditions such as an irradiation light amount, etc. for plant cultivation can be strictly controlled.

Furthermore, it has been recently known that it is effective from the viewpoint of photosynthesis of plants to apply light of three colors of red light, green light and blue light to plants with good balance when the plants are cultivated with artificial light (see JP-B-3-49530, for example). A metal halide lamp has been suitably used as a light source of artificial light (see JP-A-2003-339236 and JP-A-2009-87602, for example).

Leaf vegetables such as lettuce, herb, etc. have been hitherto mainly cultivated in plant factories, however, root vegetables whose roots or rhizomes are edible (such as carrot, radish, etc.), fruit vegetables whose berries are edible (such as cucumber, tomato, etc.) and cereal such as rice, etc. have been also recently cultivated.

The inventors of this application have knowledge that growth of plants varies in accordance with a sunshine condition subsequently to a rice seeding period, and there is a problem that cultivation using a conventional metal halide lamp as a light source for plant cultivation is lower in efficiency than cultivation based on sunshine.

SUMMARY OF THE INVENTION

The present invention has been implemented in view of the foregoing situation, and has an object to provide a metal halide lamp that can perform plant cultivation with high efficiency.

In order to attain the above object, according to the present invention, in a metal halide lamp having a luminous tube formed of translucent alumina as translucent ceramic in which additive materials (i.e., halides) are sealingly included to emit at least red, blue and green light components, an energy rate of a red light component is set to 55% to 75% and an energy ratio of a blue light component is set to 15% to 25%.

Furthermore, in the above metal halide lamp, the metal halide lamp excludes any additive which mainly emits the green light component, and light emission of the green light component is supplemented by light emission of additive material for mainly emitting the blue light component and light emission of additive material for mainly emitting the red light component.

Still furthermore, in the above metal halide lamp, the additive materials contain halides that are close to one another in vapor pressure.

According to the present invention, in the metal halide lamp for emitting at least the red, blue and green light components, the energy rate of the red light component is set to 55 to 75% and the energy rate of the blue light component is set to 15 to 25%. Therefore, growth of plants can be promoted and plant cultivation can be performed with high efficiency by using the metal halide lamp described above.

BRIEF DESCRIPTION OF THE DRAWINGS

FIG. 1 is a table showing the characteristic of a metal halide lamp used for a rice seeding cultivation test;

FIG. 3 is a table showing a rice seeding cultivation test condition;

FIG. 5 is a table showing the characteristic of a metal halide lamp used for a rice cultivation test;

FIG. 7 is a table showing a rice cultivation test condition;

FIGS. 10A to 10D are tables showing the types of additives enclosed in a luminous tube (light emission tube) of a metal halide lamp, wherein FIG. 10A is a table showing the inclusion amounts of the additives, FIG. 10B is a table showing an inclusion weight ratio of the additives, FIG. 10C is a table showing a mole ratio (%) of the additives, and FIG. 10D is a table showing the volume ratio of the additives;

FIGS. 11A and 11B are tables showing the electrical and optical characteristics of the metal halide lamp when the light amount (intensity) of the metal halide lamp is adjusted (lighting control);

FIG. 13 is a table showing variation of the energy ratio when the light amount (intensity) of the metal halide lamp is adjusted.

DETAILED DESCRIPTION OF THE PREFERRED EMBODIMENTS

Preferred embodiments according to the present invention will be described hereunder with reference to the accompanying drawings.

In this embodiment, it is exemplified that rice as an example of cereal is cultivated in an enclosed type plant factory. Rice cultivated in an enclosed type plant factory contains good-quality proteins, and thus it is used not only as food, but also for medical agent, chemicals, etc. which contain the good-quality proteins as active ingredients.

As described above, rice cultivation using a conventional metal halide lamp as a light source for plant cultivation is lower in efficiency than rice cultivation based on sunshine. Therefore, the inventors of this application have made various kinds of cultivation tests, and have had knowledge that with respect to rice cultivation in the enclosed type plant factory, a difference occurs in growth in accordance with the energy rates of respective light components (optic elements) of red color light (600 nm to 700 nm in wavelength) and blue color light (400 nm to 500 nm in wavelength) of a metal halide lamp. The cultivation test described above will be described hereunder.

[Rice Seeding Cultivation Test]

Figure 2:
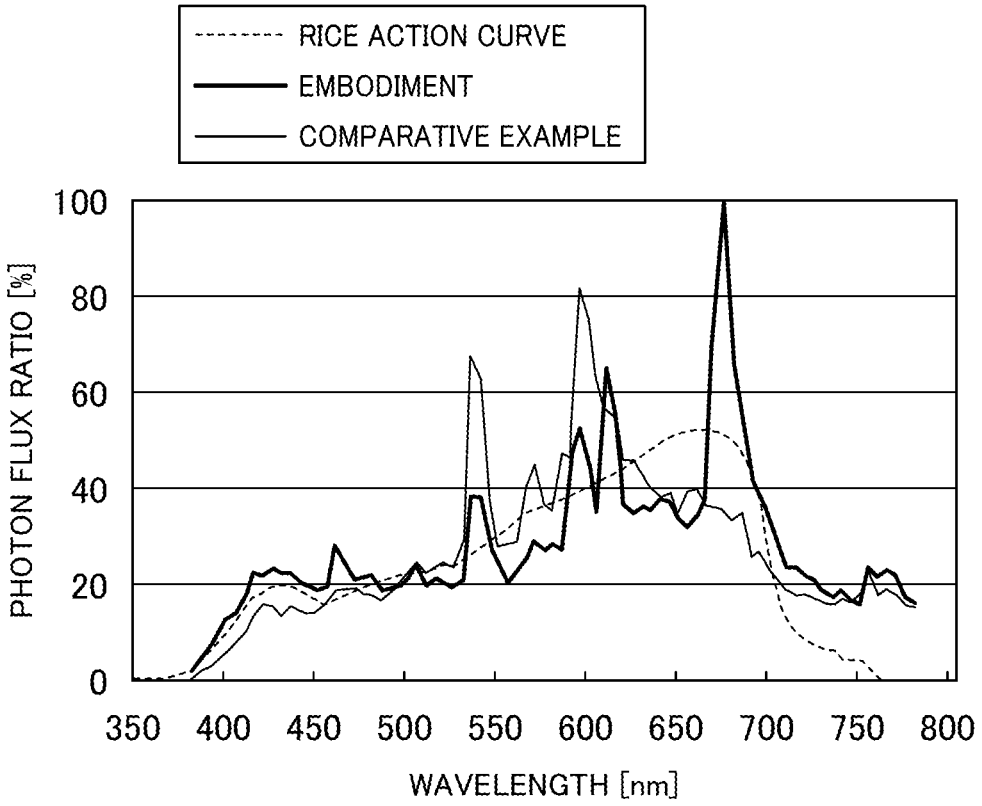
FIG. 2 is a graph showing a spectral distribution of the metal halide lamp.
Figure 4A:
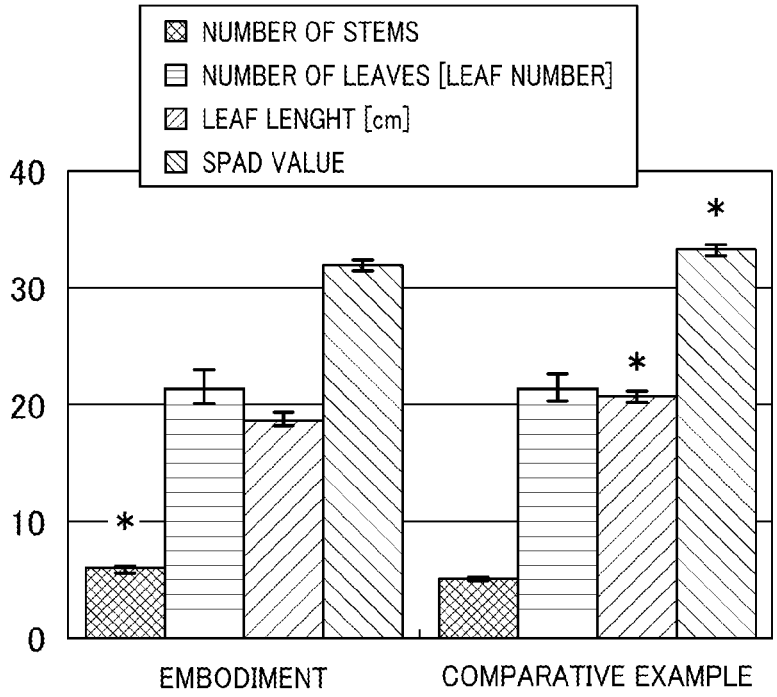
FIGS. 4A and 4B are graphs showing cultivation test results.
Figure 4B:
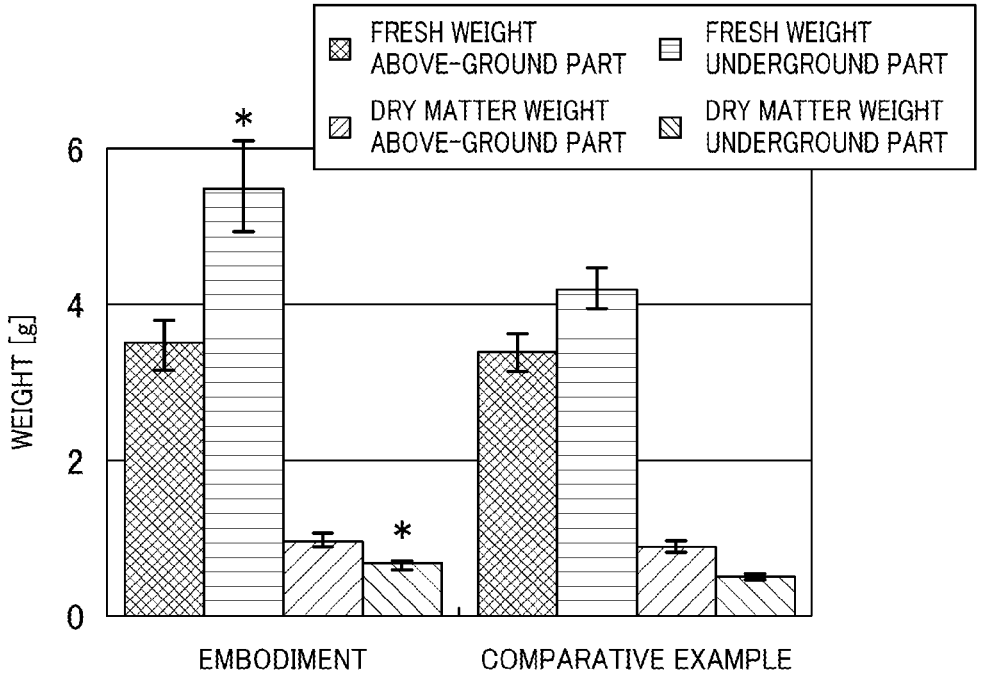

FIG. 1 is a table showing the characteristic of a metal halide lamp used in a rice seeding cultivation test, and FIG. 2 is a graph showing a spectral distribution of the metal halide lamp. FIG. 3 is a table showing a rice seeding cultivation test condition, and FIGS. 4A and 4B are graphs showing cultivation test results.

The rice seeding cultivation test is a comparison test using an energy-adjusted metal halide lamp (hereinafter referred to as "embodiment") and a commercially available general metal halide lamp (hereinafter referred to as "comparative example") in order to investigate how the difference in energy ratio between red and blue light components of artificial light to be applied during a rice seeding period in an enclose type plant factory affects growth of plants.

When plants under a rice seeding period are irradiated with light whose light amount (intensity) is the same level as light to be applied to plants under a growth period, it has been known that root rot occurs in the plants under the rice seeding period. Therefore, as shown in FIG. 1, the output power of the lamp is set to about 150 W which is lower than the output power (400 W: FIG. 5) of the lamp used during the growth period described later.

Describing the energy ratio of the lamp of this embodiment in detail, the energy rate of the light component of red color is particularly increased in photon flux ratio (energy ratio) with respect to a rice action curve in the lamp of this embodiment as shown in FIG. 2.

Furthermore, comparing with a commercially available lamp as a comparative example, according to the lamp of this embodiment, the energy rate of the light component of blue color (blue light component) in photon flux (energy) is also increased together with the energy rates of the red optic element. Therefore, the energy rate of the light component of green color (green light component) of 500 nm to 600 nm in wavelength in photon flux (energy) is reduced by the amount corresponding to the increased rates of the red and blue light components. Specifically, in the lamp of the embodiment, as shown in FIG. 1, the energy rate of the red light component is set to 42.4% (photon flux ratio: 48.7%) and the energy rate of the blue light component is set to 27.3% (photon flux ratio: 21.7%).

A rice seeding cultivation test was performed under the rice seeding cultivation test condition shown in FIG. 3 by using the lamps described above, and thus-achieved rice seeding cultivation results are shown in FIGS. 4A and 4B. As shown in FIG. 4A, with respect to the leaf length and the value of a chlorophyll meter, there is little difference between the embodiment and the comparative example. However, with respect to the number of stems (tillers) (not shown) and fresh weight of underground part and dry matter weight of underground part shown in FIG. 4B, these values are larger in the cultivation based on the lamp of this embodiment, and thus the cultivation result of this embodiment has a significant difference from the cultivation result based on the lamp of the comparative example. That is, according to the rice seeding cultivation test result, the rice growth can be more greatly promoted by performing rice cultivation under the rice seeding period with the lamp of this embodiment.

[Rice Cultivation Test]

Figure 6:
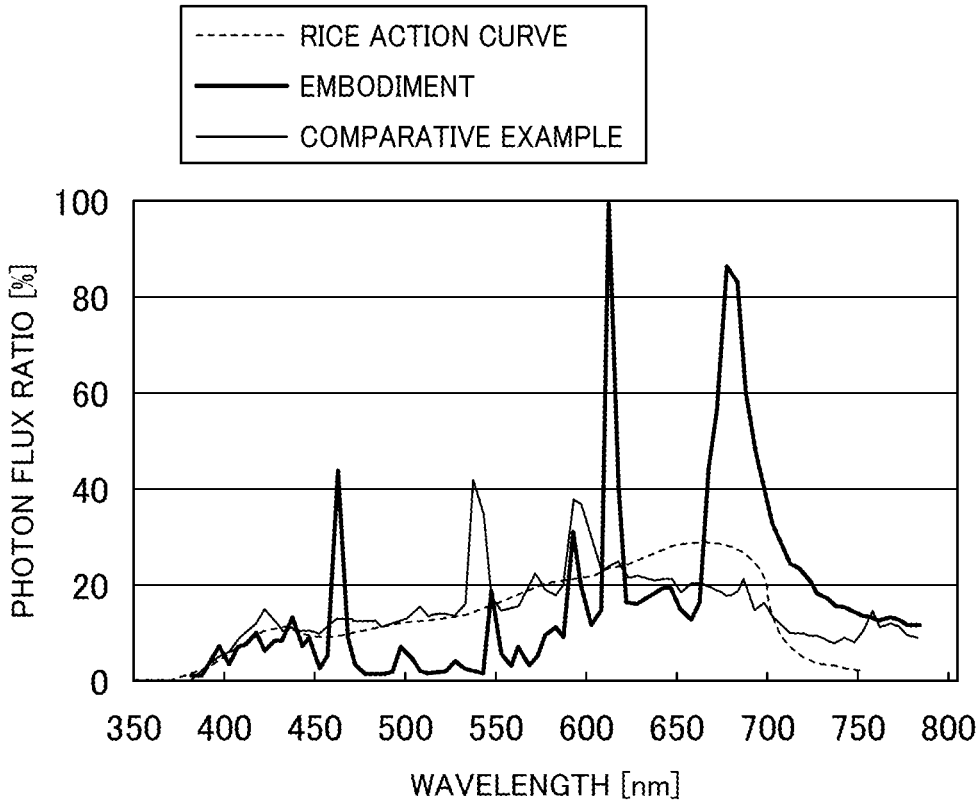
FIG. 6 is a graph showing a spectral distribution of the metal halide lamp.
Figure 8A:
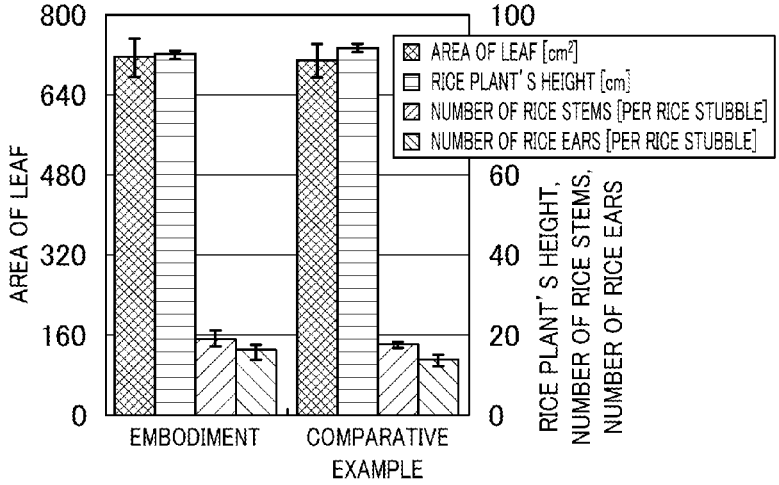
FIGS. 8A to 8C are graphs showing cultivation test results.
Figure 8B:
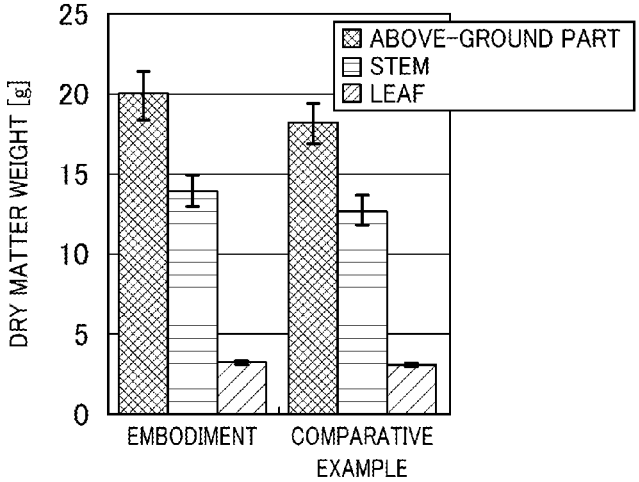
Figure 8C:
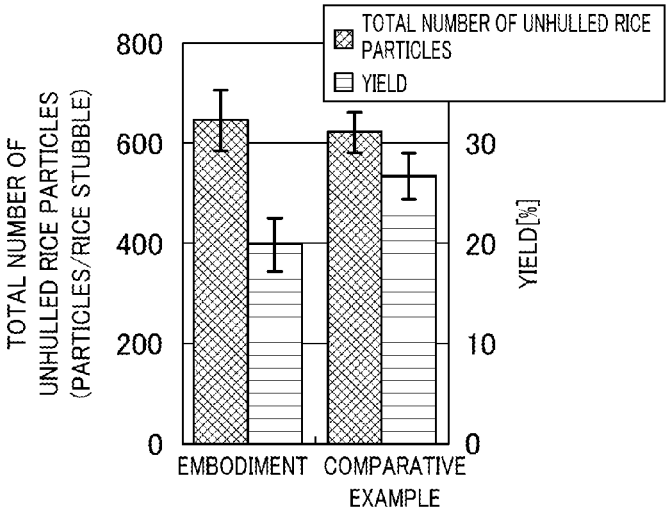

FIG. 5 is a table showing the characteristic of a metal halide lamp used for a rice cultivation test, and FIG. 6 is a graph showing a spectral distribution of the metal halide lamp. FIG. 7 is a table showing a rice cultivation test condition, and FIGS. 8A to 8C are graphs showing cultivation test results.

The rice cultivation test is a comparison test using an energy-adjusted metal halide lamp (hereinafter referred to as "embodiment") and a commercially available general metal halide lamp (hereinafter referred to as "comparative example") in order to investigate how the difference in energy ratio between red and blue light components of artificial light to be applied during a rice growth period subsequent to the rice seeding period in an enclose type plant factory affects growth of plants.

During the seeding growth period, the output power of the lamp is set to be larger than that during the seeding period, and a metal halide lamp having an output power of about 400 W is used as a lamp for each of the embodiment and the comparative example as shown in FIG. 5. However, in the lamp of this embodiment, the energy ratio of the light components of red, green and blue colors is adjusted as described later. Accordingly, when changed to the light amount (photon flux density), the photon flux density is larger in the comparative example than that in this embodiment as shown in FIG. 5.

The optical characteristic of the lamp of this embodiment will be described in detail. As is apparent from the comparison between FIG. 6 and FIG. 2, the rate of the light component of red color in the photon flux ratio (energy ratio) is more greatly increased in the lamp of the embodiment used for the rice cultivation test as compared with the lamp of the embodiment used for the rice seeding cultivation test, and thus the rate of the light component of green color of 500 nm to 600 nm in wavelength in the photon flux ratio (energy ratio) is more remarkably suppressed. In the lamp of this embodiment, the energy rate of the light component of red color is set to 65% (photon flux ratio: 70.8%), and the energy rate of the light component of blue color is set to 20% (photon flux ratio: 15.1%).

A rice cultivation test was performed under the rice cultivation test condition shown in FIG. 7 by using the lamp of this embodiment and the lamp of the comparative example, and thus-achieved rice cultivation results are shown in FIGS. 8A to 8C. As shown in FIGS. 8A to 8C, with respect to various measurement items relating to growth, there is no large significant difference between the cultivation using the lamp of this embodiment and the cultivation using the lamp of the comparative example.

However, as described above, in the rice cultivation test, the light amount of the lamp of this embodiment is smaller than that of the lamp of the comparative example. That is, the cultivation using the lamp of this embodiment having a smaller light amount can bring the same level growth result as the cultivation using the lamp of the comparative example having a larger light amount, and this means that the lamp of this embodiment can more greatly promote the growth of rice than the lamp of the comparative example.

Through various kinds of experiments, the inventors have found that the growth of rice can be promoted in both the cultivation during the rice seeding period and the cultivation during the growth period subsequent to the rice seeding period by using various types of metal halide lamps which are obtained by variously combining a red light component having an energy rate in the range from 55% to 75% and a blue light component having an energy rate in the range from 15% to 25%.

Next, a metal halide lamp 1 according to this embodiment which has an energy ratio suitable for plant cultivation will be described in detail.

Figure 9:
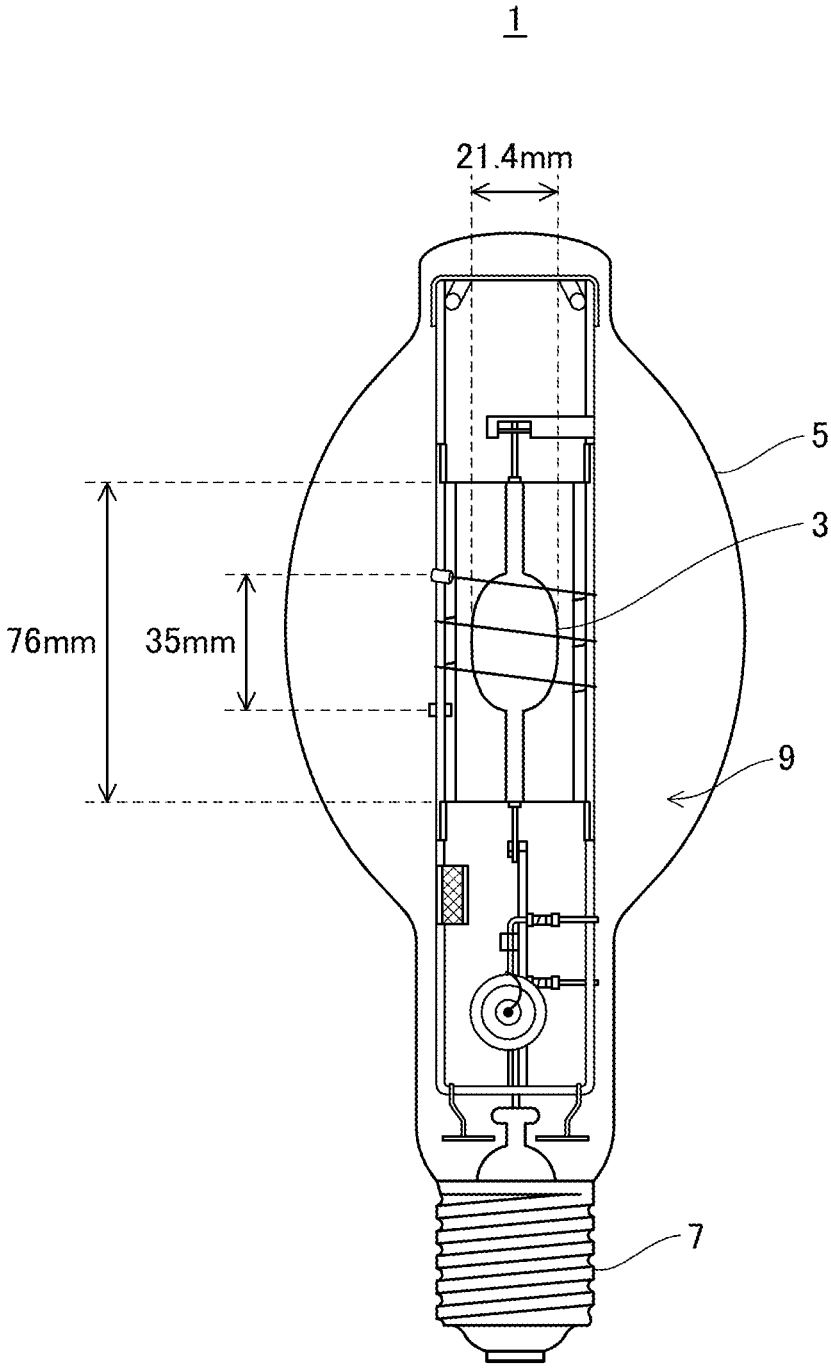
FIG. 9 is a diagram showing the construction of a metal halide lamp according to an embodiment of the present invention.

FIG. 9 is a diagram showing the construction of the metal halide lamp 1 according to this embodiment. The metal halide lamp 1 is a lamp which is suitably used as a light source for plant cultivation in an enclosed type plant factory, and has a luminous tube (light emission tube) 3, an outer globe 5 and a lamp base (metal cap) 7. A pair of electrodes are sealed in the luminous tube 3, and halides for light emission are sealingly included as additives in the luminous tube 3.

The luminous tube 3 is formed of a translucent alumina tube which is a kind of translucent ceramic material. Electrically conductive cermet caps formed of alumina tungsten are sealed as electrodes at both the end portions of the luminous tube 3 by a sealing member, and additives such as argon, lithium iodide, thallium iodide, etc. are sealingly included as starting rare gas by every predetermined amount.

The luminous tube 3 is sealed by the outer globe 5 and the lamp base 7, and the inner space 9 of the outer globe 5 is kept vacuum.

The luminescence property (light emission characteristic) of the lamp varies in accordance with the shape and dimension of the luminous tube 3. According to this embodiment, the luminous tube 3 is configured so as to comprise a substantially cylindrical body of about 21.4 mm in diameter and about 35 mm in height and slender tubular bodies which are joined to both the ends of the cylindrical body so that the total length of the luminous tube 3 is set to about 76 mm.

It is generally known that light of 400 nm to 700 nm in wavelength (called as "photosynthesis effective radiation") is effective as an energy source for photosynthesis of plants, and light having wavelengths of the photosynthesis effective radiation is required to have a high light intensity because it serves as an energy source for photosynthesis. In this embodiment, the metal halide lamp 1 is used as a light source for growing plants, thereby making it possible to radiate plants with light having a high intensity (large light amount).

FIGS. 10A to 10D are tables showing the types of additives which are sealingly included in the luminous tube 3 of the metal halide lamp 1, wherein FIG. 10A shows inclusion amounts of the additives, FIG. 10B shows the inclusion weight ratio of the additives, FIG. 10C shows the mole ratio (%) of the additives and FIG. 10D shows the volume ratio of the additives. In FIGS. 10A to 10D, the metal halide lamp 1 of this embodiment (represented as "embodiment (dimmable type)" is shown together with the lamp of the comparative example and the lamps of the embodiment used for the rice seeding cultivation test and the rice cultivation test.

The emission spectrum of the metal halide lamp 1, that is, the energy (energy ratio) of the light components of red, green and blue colors is dependent on the additives which are sealingly included in the luminous tube 3. That is, as shown in FIGS. 10A to 10D, LiI as metal halide emitting the light component of red color is added as an additive in addition to $DyI_3$—$HoI_3$—NaI and $CaI_2$ as metal halides which mainly emit the light component of blue color, thereby constructing the metal halide lamp 1 in which the energy rates of the light components of the red and blue colors are increased.

Particularly, in the metal halide lamp 1 of this embodiment (i.e., the embodiment (dimmable type)) and the lamp of the embodiment used for the rice cultivation test, additives such as $Tm_3$ (thulium iodide) and TlI (thallium iodide) which mainly emit the light component of green color (500 nm to 600 nm in wavelength) are excluded as non-additives, and the light component of green color is supplemented by light emission of the additive mainly emitting the light component of blue color and light emission of the additive mainly emitting the light component of red color. Therefore, the energy rate of the light component of green color is suppressed to 20% or less, so that the energy rates of the light components of blue and red colors are efficiently increased.

As described above, it is necessary that the irradiation light amount to be applied in the rice seeding period is set to be lower than that in the growth period in order to prevent root rot. Furthermore, it is generally known that when a metal halide lamp is turned on while dimmed, the energy ratio between the red and blue light components varies as the output of the metal halide lamp is reduced due to the difference in vapor pressure among the respective halides which are sealingly included as additives in the luminous tube.

That is, even in a case where a metal halide lamp is configured to have an optimum energy ratio to the cultivation of rice seeding under the growth period by adjusting the additives to be included in the metal halide lamp, when the lighting control (control of light intensity or light amount, control of dimming or the like) is performed on the metal halide lamp by reducing the output of the lamp so that the metal halide lamp is used for growth of rice under the seeding period, the energy ratio between the red and blue light components varies, and thus the energy ratio gets out of the optimum range.

In order to solve this problem, according to the metal halide lamp 1 of this embodiment, halides which are close to one another in vapor pressure are selected and combined as additives to be sealingly included in the luminous tube 3. Therefore, even when the temperature of the luminous tube 3 varies in accordance with variation of input power to the lamp under the lighting control, the vapor pressures of the respective halides as the additives vary substantially in the same manner because the vapor pressures are close to each other, thereby suppressing the variation of the energy ratio between the red and blue light components. A set of ($DyI_3$—$HoI_3$—NaI, $CaI_2$, LiI, $HgI_2$) is selected as a combination of the halides described above as shown in FIGS. 10A to 10D.

The inclusion amounts of the respective additives are adjusted so that the energy rate of the red light component is kept in the range from 55% to 75% and the energy rate of the blue light component is kept in the range from 15% to 25% even when the output of the lamp is reduced due to lighting control.

The vapor pressure in a 400 W lamp of each embodiment shown in FIGS. 10A to 10D is set to 3.2 atm (at the luminous tube temperature of 1300K) in the lamp of the comparative example, 5.0 atm (at the luminous tube temperature of 1300K) in the lamp of the embodiment (rice cultivation test) and 5.7 atm (at the luminous tube temperature of 1300K) in the lamp of the embodiment (dimmable type). With respect to the 150 W lamp of the embodiment (rice seeding cultivation test), the vapor pressure of the 150 W lamp is set to 7.1 atm (at the luminous tube temperature of 1300K).

Figure 12A:
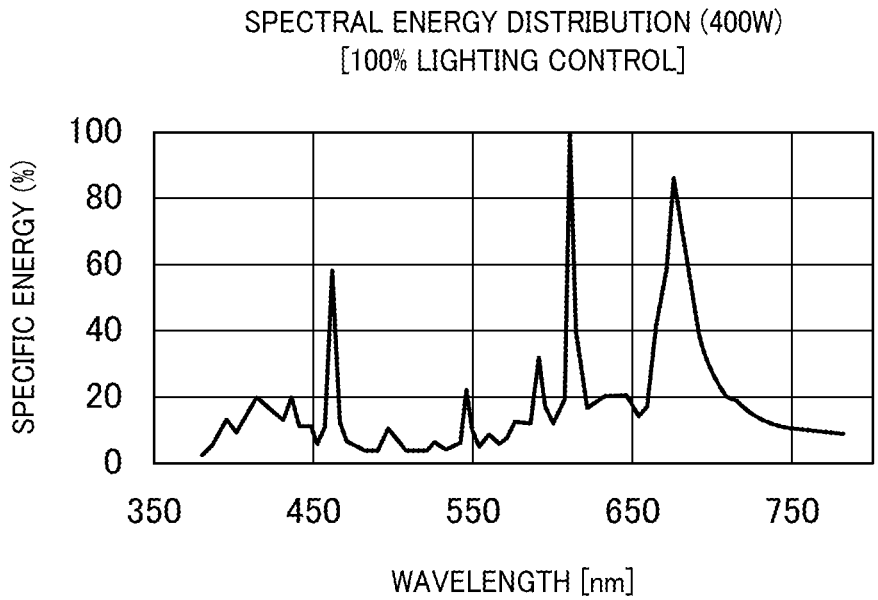
FIGS. 12A and 12B are graphs showing spectral energy distributions when the light amount (intensity) of the metal halide lamp is adjusted.
Figure 12B:
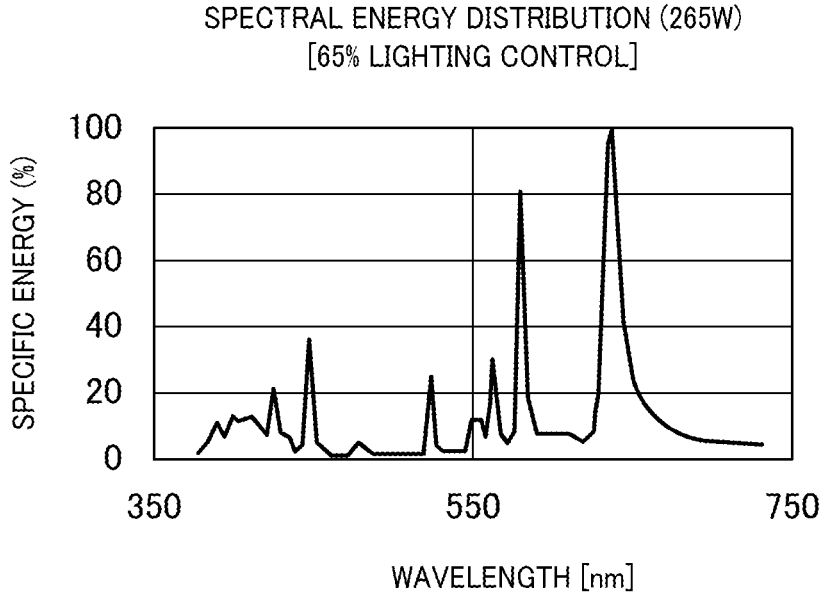

FIGS. 11A and 11B are tables showing electric and optical characteristics of the metal halide lamp 1 under the lighting control, and FIGS. 12A and 12B are graphs showing spectral energy distributions of the metal halide lamp 1 under the lighting control. FIG. 13 is a table showing variation of the energy ratio of the metal halide lamp 1 under the lighting control. The lighting control shown in FIG. 13 is performed by constant current control for controlling a current value on the basis of a general rectangular wave of an electronic ballast.

According to this embodiment, as shown in these figures, the energy rate of the red light component is kept in the range from 55% to 75% and the energy rate of the blue light component is kept in the range from 15% to 25% at least in the lighting control range from 100% to 65% with respect to the metal halide lamp 1 whose lamp output is equal to 400 W.

Particularly, as shown in FIGS. 12A and 125, the spectral energy distribution under 100% lighting control (i.e., the output power is set to 400 W) is also substantially equal to the spectral energy distribution under 65% lighting control (i.e, the output power is set to 265 W), and thus rice can be efficiently and consistently grown from the seeding period till the growth period by using the same metal halide lamp 1.

As described above, according to this embodiment, the energy rate of a red light component is set to 55% to 75% and the energy ratio of a blue light component is set to 15% to 25% in a metal halide lamp 1 having a luminous tube 3 formed of translucent alumina as translucent ceramic in which additives of halides are sealingly included to emit at least red, blue and green light components. Accordingly, grow of plants can be promoted, and plant cultivation can be efficiently performed.

Furthermore, a metal halide lamp 1 that can prevent transmission of iodides, keep the energy ratio of the blue, green and red light components over a long term and has excellent durability to aged deterioration can be provided by using a luminous tube 3 formed of alumina.

Furthermore, according to this embodiment, additives which mainly emit a green light component (for example, Tms, TiI) are excluded, and the light emission of the green light component can be supplemented by the light emission of additives for mainly emitting a blue light component ($DyI_3$—$HoI_3$—NaI or $CaI_2$) and the light emission of additives for mainly emitting a red light component (for example, LiI). Therefore, the energy rates of the red and blue light components can be simply and efficiently increased.

According to this embodiment, the halides which are close to one another in vapor pressure are selected and combined as additives, and the variation of the energy rates of the red and blue light components which is caused by the temperature variation of the luminous tube 3 due to variation of an input voltage to the lamp under the lighting control can be suppressed. Therefore, in plant cultivation, plants can be consistently grown with high efficiency from the seeding period till the growth period by using the same metal halide lamp 1.

The present invention is not limited to the above embodiments, and various modifications may be made without departing from the subject matter of the present invention. For example, in the above embodiments, the enclosed type plant factory is adopted as a plant factor. However, the plant factor is not limited to the enclosed type plant factor, and the present invention may be applied to a light source for plant cultivation in a plant factory which uses sunlight (natural light) in combination.

What is claimed is:

1. A metal halide lamp having a luminous tube formed of translucent ceramic in which additive materials are sealingly included to emit at least red, blue and green light components, wherein an energy rate of a red light component is set to 55% to 75% and an energy rate of a blue light component is set to 15% to 25%, wherein a sum of energy rates of the light components is set to 100%, and the metal halide lamp excludes any additive which mainly emits the green light component, and light emission of the green light component is supplemented by light emission of additive material for mainly emitting the blue light component and light emission of additive material for mainly emitting the red light component.

2. The metal halide lamp according to claim 1, wherein the additive materials contain halides that are close to one another in vapor pressure.

* * * * *